US005708928A

United States Patent [19]

Fukunaga

[11] Patent Number: 5,708,928

[45] Date of Patent: Jan. 13, 1998

[54] COMPACT CLEANING APPARATUS FOR IMAGE FORMING APPARATUS

[75] Inventor: Yasuyuki Fukunaga, Osaka, Japan

[73] Assignee: MITA Industrial Co., Ltd., Osaka, Japan

[21] Appl. No.: 757,441

[22] Filed: Nov. 27, 1996

[30] Foreign Application Priority Data

Nov. 30, 1995 [JP] Japan ..... 7-312554
Nov. 30, 1995 [JP] Japan ..... 7-312555

[51] Int. Cl.[6] ..... G03G 15/20

[52] U.S. Cl. ..... 399/123; 399/101; 399/345

[58] Field of Search ..... 399/101, 345, 399/350, 353, 123

[56] References Cited

U.S. PATENT DOCUMENTS

| | | | |
|---|---|---|---|
| 3,848,992 | 11/1974 | Smith . | |
| 4,131,359 | 12/1978 | Honda . | |
| 4,158,498 | 6/1979 | Ohmori . | |
| 4,284,345 | 8/1981 | Sugiyama et al. | 399/351 |
| 4,908,671 | 3/1990 | Kusumoto | 399/123 |
| 4,969,015 | 11/1990 | Sanpe | 399/345 |
| 5,390,010 | 2/1995 | Yamahata et al. | 399/308 |
| 5,408,303 | 4/1995 | Fukunaga et al. | 399/123 |
| 5,442,422 | 8/1995 | Owens, Jr. et al. | 399/103 |

*Primary Examiner*—Robert Beatty
*Attorney, Agent, or Firm*—Shinjyu Office of Patent Attorney

[57] ABSTRACT

A compact cleaning apparatus capable of having a good cleaning function is provided with an image forming apparatus. The cleaning apparatus of the image forming apparatus is pivoted inside this image forming apparatus and cleans an intermediate transfer belt or photosensitive drum. This cleaning apparatus is arranged by a casing having an opening for collecting toner stripped from the surface of the object; a cleaning member mounted on one side edge of the opening of the casing and depressed against the surface of the object; and a drive mechanism having a fulcrum located below the opening of the casing, for pivoting the casing in a direction along which the casing is separated from the object. Three shafts cooperate to perform an engagement or removal operation.

13 Claims, 4 Drawing Sheets

COMPACT CLEANING APPARATUS FOR IMAGE FORMING APPARATUS

BACKGROUND OF THE INVENTION

A. Field of the Invention

The present invention generally relates to a cleaning apparatus in an image forming apparatus such as a photocopying machine. More specifically, the present invention is directed to a cleaning apparatus of an image forming apparatus which cleans a surface of an object rotatably driven within the image forming apparatus, the surface of the object used to form a toner image to be transferred to paper.

B. Description of the Related Art

In image forming apparatuses, such as color copying machines, a color image is transferred to a piece of paper by employing an intermediate transfer member such as a transfer belt. In such a copying system, an original image is read by an exposing unit, and then this read image is decomposed or separated into four colors of magenta, cyan, yellow, and black. An electrostatic latent image corresponding to a single color among these four colors is formed on a photosensitive drum, and the latent image formed on a photosensitive drum is developed by using the corresponding color toner. Furthermore, this toner image is transferred to the transfer belt rotatably driven while abutting against this photosensitive drum. A similar stage is repeated as to the respective four colors, so that a full-colored toner image is formed on the transfer belt. Thereafter, a paper is transported between the transfer belt and a transfer roller provided opposite to the transfer belt so that the full-colored toner image is transferred onto the paper.

In this type of color copying machine, in order to remove the toner remaining on the surface of the transfer belt after the toner image has been transferred to the paper, a cleaning apparatus for the transfer belt is provided. This cleaning apparatus is equipped with, for instance, a cleaning blade whose tip portion abuts against the transfer belt in order to be located opposite to the rotation direction of the transfer belt, a casing for collecting the toner stripped from the cleaning blade, and an auxiliary blade for guiding the toner stripped by the cleaning blade into the casing. The cleaning blade is provided opposite to the auxiliary blade with sandwiching an opening. This opening is formed in the side surface of the casing, and collects the toner. These cleaning/auxiliary blades are depressed against the surface of the transfer belt. It should be noted that both the cleaning blade and the auxiliary blade must be separated from the surface of the transfer belt while the first colored toner image is being transferred from the photosensitive drum to the transfer belt, and when the full-colored toner image is transferred from the toner belt to the paper.

In such a cleaning apparatus for the transfer belt, in order for the cleaning blade and the auxiliary blade to be depressed against and separated from the transfer belt, each of the respective blades must be selectively rotatable driven in opposing directions. Accordingly, independent drive mechanisms are required for each blade. In such a configuration, the cleaning apparatus requires a complicated structure that is not compact, and is expensive to manufacture.

The problems described above are not limited to the above-described color copying machine, but may be similarly applied to black-colored toner image copying machines equipped with transfer belts, and cleaning apparatuses provided with photosensitive drums. The complex drive mechanisms which are used to position the blades or other similar cleaning member are costly and take up space making the configurations complicated, expensive to manufacture and bulky.

Further, in such cleaning apparatus, a guide rail is sometimes employed for detachably mounting the cleaning apparatus on the image forming apparatus. In general, the cleaning apparatus is mounted or removed in such a manner that this cleaning apparatus is moved along the forward/backward direction by using this rail. However, there are many cases that the toner collecting opening of the cleaning apparatus is formed in the side surface thereof due to its inherent structure. Accordingly, when the cleaning apparatus is mounted/removed, there is a risk that the toner is scattered from the inside of the casing. If the guide rail has play, the cleaning blade of the cleaning apparatus, the auxiliary blade, or a portion of the casing may abut against the transfer belt, and thus may damage this transfer belt.

SUMMARY OF THE INVENTION

An object of the present invention is to provide a cleaning apparatus in an image forming apparatus which is compact and yet provides a reliable cleaning function.

Another object of the present invention is to provide a cleaning apparatus of an image forming apparatus, which can be made simple, and can be readily mounted/removed to thereby preventing the toner from being scattered, and further preventing the cleaning apparatus from being damaged.

In accordance with one aspect of the present invention, a cleaning apparatus in an image forming apparatus includes a shaft mounted within an image forming apparatus. A casing is pivotally mounted on the shaft adjacent to an image retaining member, the casing being formed with an opening for collecting toner stripped from a surface of the image retaining member. A cleaning member is mounted on one edge of the opening of the casing and is configured to contact the surface of the image retaining member. The shaft is positioned below the opening such that the casing has a fulcrum located below the opening.

Preferably, the cleaning member is mounted such that a tip portion thereof extends in a direction opposite to a rotational direction of the surface of the image retaining member.

Preferably, the cleaning member is a cleaning blade made of one of a synthetic resin and a metal.

Preferably, the cleaning member is mounted on one side edge located below the opening of the casing.

Preferably, the cleaning member is mounted on one side edge above the opening of the casing, and the cleaning apparatus further includes an auxiliary cleaning member mounted on another side edge below the opening of the casing opposite the cleaning member, for guiding stripped toner into the casing.

Preferably, the auxiliary cleaning member is a blade made of one of a synthetic resin and a metal.

Preferably, the image retaining member is a photosensitive drum.

Preferably, the image retaining member is an intermediate transfer belt onto which a toner image formed on the surface of the photosensitive drum is transferred, and which transfers the toner image onto transported paper.

Preferably, the intermediate transfer belt is suspended between a drive roller and a follower roller.

Preferably, a tip portion of the cleaning member is located on the casing such that in response to selective positioning of the casing the tip portion is depressed against the surface of the image retaining member.

Preferably, an engagement mechanism is supported within the image forming apparatus substantially below the opening of the casing, and guided by a supporting shaft provided in the image forming apparatus, whereby the casing is selectively guided into engagement and disengagement with the image retaining member in response to movement of the engagement mechanism.

Preferably, an engagement member is pivotably mounted to a rotatable shaft within the image forming apparatus, the engagement member being located adjacent to the casing. A support member is mounted on the supporting shaft. A solenoid is mounted to the support member and is engaged with the engagement member such that movement of the solenoid causes movement of the engagement member into engagement and disengagement with the casing.

Preferably, the supporting shaft is configured for positioning within the image forming apparatus in an installed position and to extend out of the image forming apparatus in an un-installed position, such that in the un-installed position the casing is removable from the image forming apparatus.

In the cleaning apparatus of the image forming apparatus, according to the present invention, the casing can be swung by the supported portion located below the opening of the casing, and the cleaning apparatus can be mounted/removed under such a condition that the cleaning member is sufficiently separated from the surface of the object. As a result, the damage of the cleaning apparatus can be prevented. Since the casing can be guided to a preselected position while the supported portion is guided by the supporting shaft provided in the image forming apparatus, the cleaning apparatus can be firmly mounted/removed with employing a simple structure without employing a separate guide member.

As well, in the present invention, the supported unit formed below the opening is guided along the supporting shaft provided in the image forming apparatus, and the casing can be guided to a predetermined position. Therefore, the casing can be firmly mounted at a predetermined position. This supported unit is supported by the supporting shaft in order to swing the casing. As a consequence, when the cleaning member is depressed/separated against/from the surface of the object, the supporting shaft for pivoting the casing has another function of the guide member when the casing is mounted. Thus, the cleaning apparatus can be mounted/removed with a simple structure. Since the cleaning apparatus can be mounted/removed in such a manner that the opening of the casing is pivoted to be directed upwardly, it is possible to prevent the toner from being scattered.

These and other objects, features, aspects and advantages of the present invention will become more fully apparent from the following detailed description of the present invention when taken in conjunction with the accompanying drawings where like reference numerals denote corresponding parts throughout, in which:

DETAILED DESCRIPTION OF THE PREFERRED EMBODIMENTS

Figure 1:
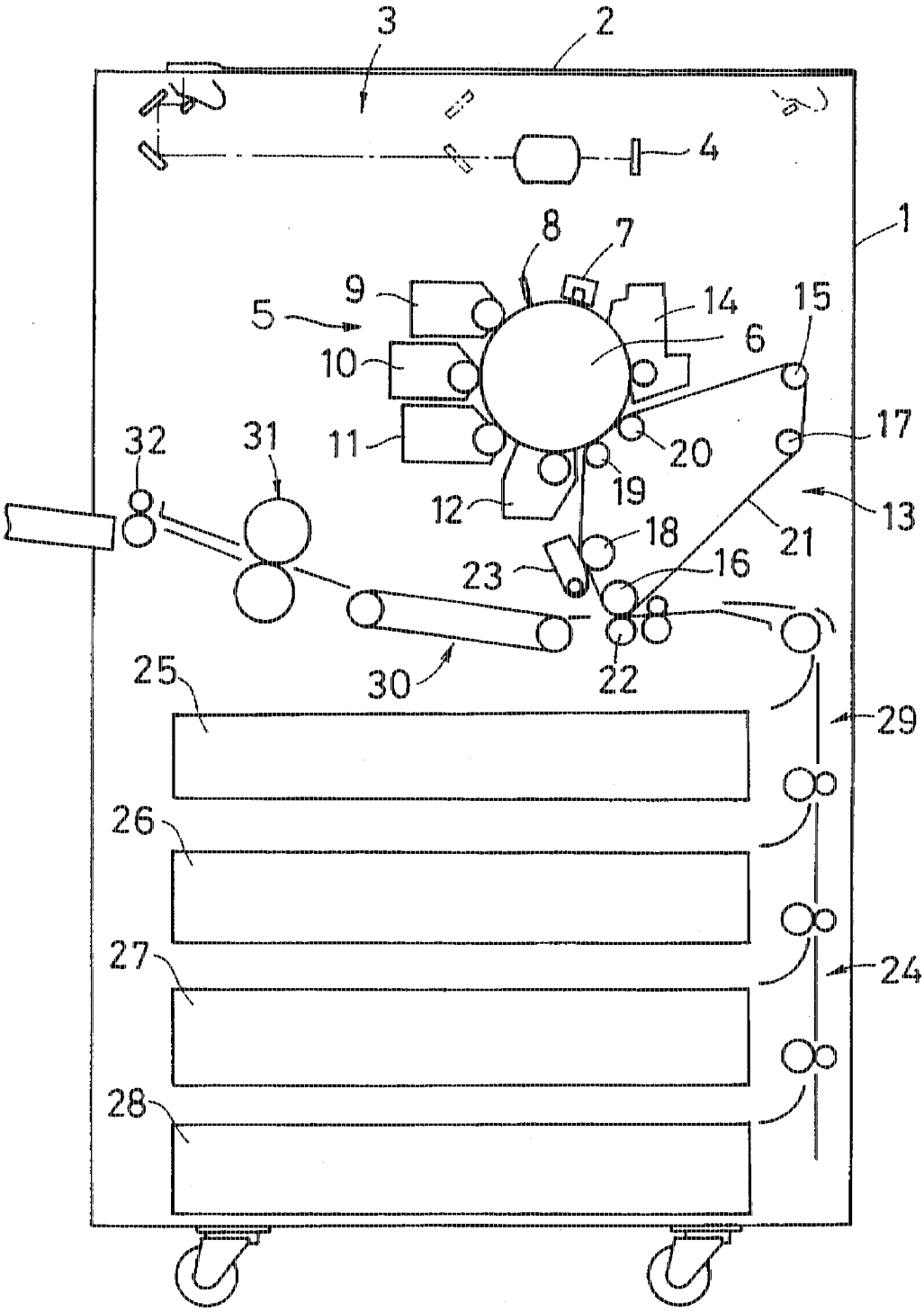
FIG. 1 is a cross-sectional view schematically showing an arrangement of a copying machine according to one embodiment of the present invention.

FIG. 1 schematically shows a copying machine to which an embodiment of the present invention is applied.

A copying machine 1 includes an original glass 2 on an upper surface thereof. A book, paper, photograph or the like may be positioned thereon for photocopying. A cover (not shown) is usually employed for covering the original glass 2, the cover (not shown) is movably fixed on an upper surface of the copying machine 1 in such a manner that the original cover may be freely opened and closed. Furthermore, an operation panel (not shown) containing an input unit such as a ten key pad, including a print key, and a display unit constructed of a liquid crystal display element and an LED (light emitting diode) is arranged on the upper surface of the copying machine 1.

An exposure unit 3 for reading the original mounted on the original glass 2 is provided in an upper portion of the copying machine 1. The exposure unit 3 includes a light source, a mirror, and a lens unit. An image of an original exposed by the exposing unit 3 is scanned by a color CCD (charge-coupled device) 4, and then the scanned original image is stored in memory (not shown) as a two-dimensional image.

At a central portion of the copying machine 1, an image forming unit 5 is provided which forms a toner image of a read original. The image forming unit 5 contains a photosensitive drive 6, in which an electrostatic latent image is formed on a surface thereof. Around the photosensitive drum 6 there is arranged a charging apparatus 7; an optical system 8 for irradiating light so as to form an electrostatic latent image; developers 9, 10, 11 and 12; a transfer apparatus 13; and a cleaning apparatus 14. In the developers 9, 10, 11 and 12, magenta toner, cyan toner, yellow toner, and black toner are disposed, respectively. The developers 9, 10, 11 and 12 develop toner images corresponding to the color toner on the photosensitive drum 6.

A cleaning member such as a cleaning roller, a cleaning blade, or a fur brush is provided in the cleaning apparatus 14. These cleaning members are pressure-contacted on the surface of the photosensitive drum, so that the toner present on the photosensitive drum 6 can be removed.

The transfer apparatus 13 contains a drive roller 15, follower rollers 16 and 17; auxiliary rollers 18 and 19; and a bias roller 20. A transfer belt 21 extends around the rollers 15–20. The transfer apparatus 13 also includes: a secondary transfer roller 22 and another cleaning apparatus 23, which are positioned adjacent to the transfer belt 21. The transfer belt 21 is rotatably driven by the drive roller 15 at the substantially same speed as that of the surface of the photosensitive drum 6. The transfer belt 21 abuts against the surface of the photosensitive drum 6 between the auxiliary roller 19 and the bias roller 20. The bias roller 20 is arranged inside the transfer belt 21.

The high voltage electron charges are biased to this bias roller 20, so that the toner adhering on the surface of the photosensitive drum 6 may be transferred to the transfer belt 21. Both the follower roller 16 and the secondary transfer roller 22 are arranged opposite to each other in such a manner that this follower roller 16 abuts against the secondary transfer roller 22 via the transfer belt 21 and the transported paper. Since high voltage electron charges are loaded on the secondary transfer roller 22, the toner on the transfer belt 21 is transferred to the paper as the paper travels between the rollers 16 and 22.

A paper supply unit 24 is provided in a lower portion of the copying machine 1. The paper supply unit 24 is equipped with paper supply cassettes 25, 26, 27, 28, and also a paper transport path 29. These paper supply cassettes 25, 26, 27 and 28 are arranged at the lower portion of the copying machine 1 along the vertical direction (as viewed in FIG. 1). The paper transport path 29 transports the papers stored in the paper supply cassettes 25 to 28 to the image forming unit 5. On a down stream side of the paper transport direction by the image forming unit 5, there are provided an ejected paper transport path 30 for transporting the paper to a left side of the image forming apparatus 1 shown in FIG. 1; a fixing apparatus 31 for melting and fixing a toner image formed on the paper; an ejection roller 32 for ejecting the paper after the toner image fixing stage, and an ejected paper tray 33 for receiving the ejected paper.

Figure 2:
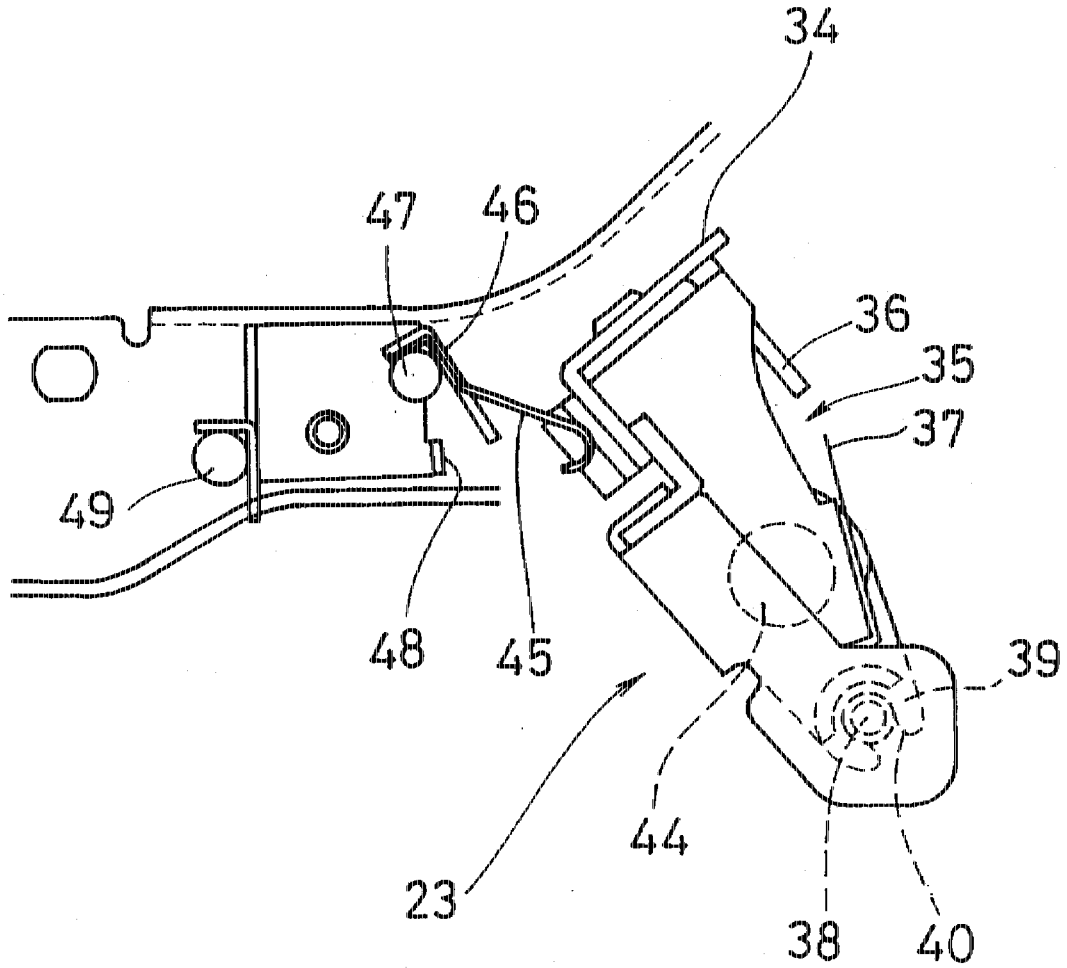
FIG. 2 is a fragmentary, side view of a portion of the copying machine depicted in FIG. 1 on a slightly enlarged scale with some adjacent portions of the copying machine removed for clarity.
Figure 3:
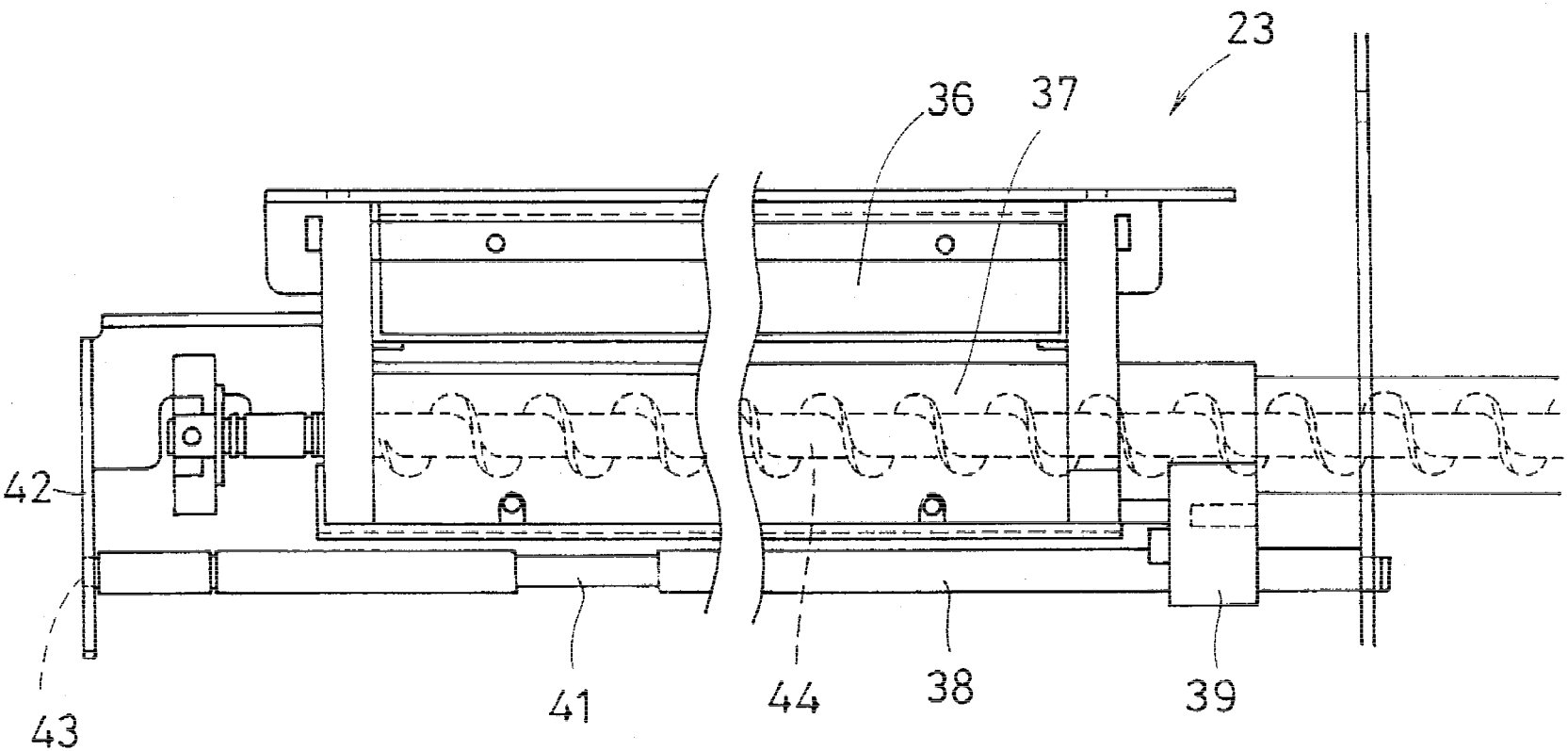
FIG. 3 is a front view of the portions of the copying machine depicted in FIG. 2.
Figure 4:
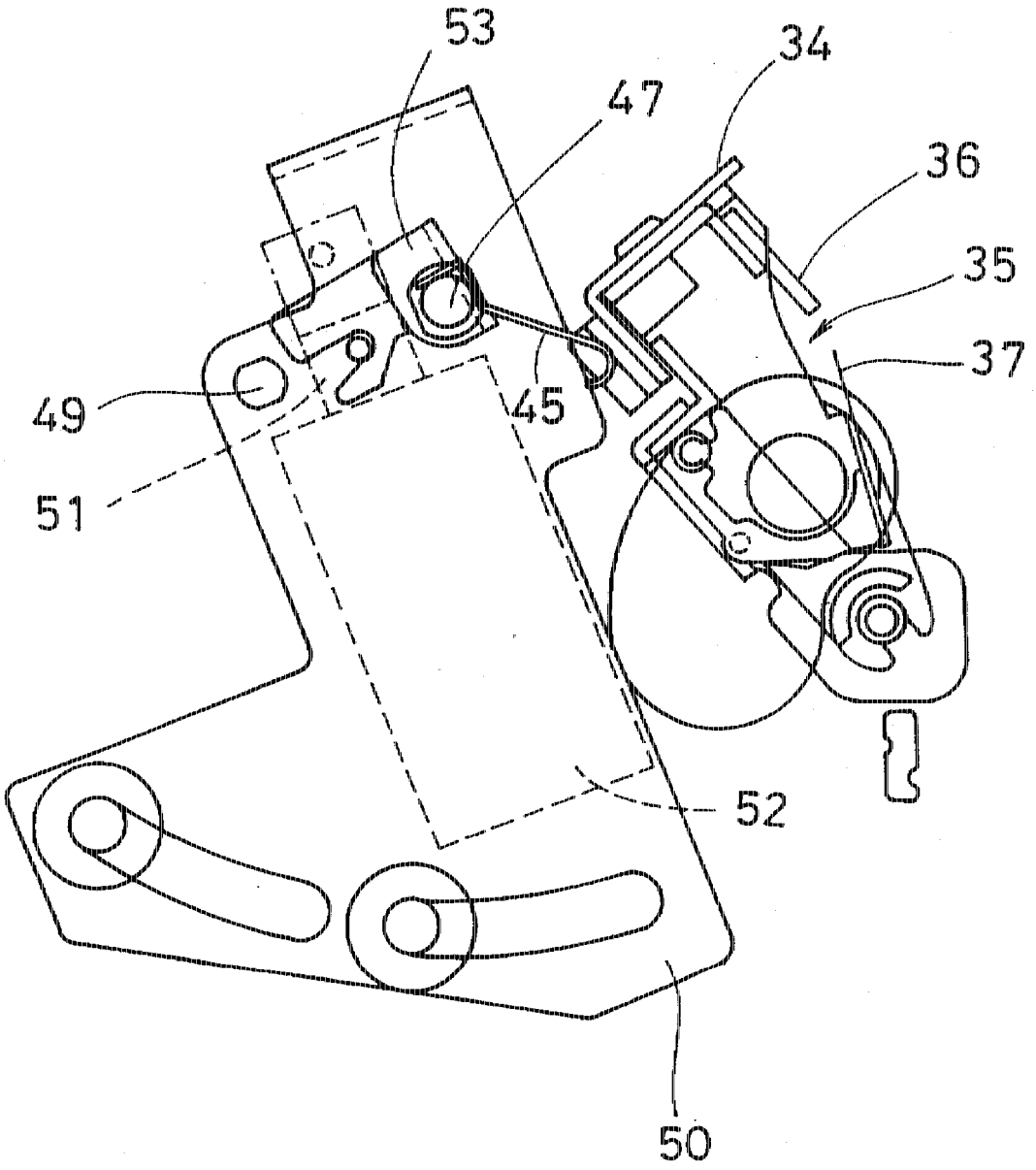
FIG. 4 is a side view, similar to FIG. 2, showing the relationship between several portions of the copying machine.

The cleaning apparatus 23 provided in the transfer apparatus 13 is arranged as shown more clearly in FIG. 2 to FIG. 4.

The cleaning apparatus 23 has a casing 34 having an opening 35 on a side surface thereof. A main blade 36 made of a hard synthetic resin is mounted on a side edge located above this opening 35. A lower blade 37 made of a soft synthetic resin is mounted on a side edge located below the opening 35. A lower end portion of the casing 34 constitutes a supported portion 39 which is engaged with a supporting shaft 38 fixed on an inner side of the copying machine 1. Thus the cleaning apparatus 23 is pivotably mounted on the support shaft 38.

The supported portion 39 includes an engage groove 40 opened downwardly, and is formed with a substantially C-shape. As indicated in FIG. 3, the supported portion 39 is provided on one edge of the cleaning apparatus 23 along the longitudinal direction thereof. A width of the engaging groove 40 of the supported portion 39 is set to be smaller than an outer diameter of the supporting shaft 38, and larger than an outer diameter of a fitting groove portion 41 formed in the supporting shaft 38. Therefore, the support portion 39 (and hence the cleaning apparatus 23) may be removed from the supporting shaft 38 by aligning the groove 40 with the fitting groove portion 41.

A mounting plate 42 is provided on an opposite end of the cleaning apparatus 23 along the longitudinal direction thereof. A mounting hole 43 is formed in the mounting plate 42 in correspondence with the end portion of the supporting shaft 39. A spiral 44 rotated by a motor (not shown) is provided in the cleaning member 23.

A depression lever 46 is provided in one portion of the copying machine 1, and a depression leaf spring 45 is mounted on the depression lever 46. The depression leaf spring 45 is configured for engagement with the casing 34 of the cleaning apparatus 23, as is explained below. The depression lever 46 is fixed on a pivot shaft 47. The pivot shaft 47 is pivotably mounted within the copying machine 1. Therefore, the leaf spring 45 and the depression lever 46 can be swung or pivoted in response to the pivot motion of the pivot shaft 47. A position defining plate 48 for defining one movement position of the depression lever 46 is mounted near the pivot shaft 47. The position defining plate 48 is mounted on a sliding shaft 49 slidable along a direction perpendicular to the plain surface of FIG. 2. The position defining plate 48 may be moved with the sliding shaft 49 in and out of the copying machine 1. When positioned within the copying machine 1, the position defining plate 48 defines a stopping point for the depression leaf spring 45 as it pivots with the pivot shaft 47. In other words, the movement of the depression leaf spring 45 is limited by engagement with the position defining plate 48. Conversely, when the position defining plate 48 is slide out of the copying machine 1 by movement of the sliding shaft 49, the movement of the depression leaf spring 45 is not longer restricted by the position defining plate 48.

As shown in FIG. 4, a solenoid mounting plate 50 is mounted within the copying machine 1 adjacent to one side of the cleaning apparatus 23 along the longitudinal direction thereof. The solenoid mounting plate 50 is positioned behind the position defining plate 48 such that the position defining plate 48 is freely moveable in and out of the copying machine 1, as described above. A solenoid 52 is mounted to the solenoid mounting plate 50. The solenoid 52 includes a plunger 51 that is inwardly moved when a signal is inputted to this solenoid 52 to a retracted position. A solenoid lever 53 is in contact with the plunger 51 via a pin which extends through the plunger 51. The solenoid lever 53 is rigidly mounted on the pivot shaft 47 such that as the solenoid lever 53 pivots, so does the pivot shaft 47. The pivot shaft 47 is therefore pivoted by moving the plunger 51 of the solenoid 52. The solenoid lever 53 is shown in FIG. 4 with the plunger 51 in the retracted position.

In order to install the cleaning apparatus 23 in the copying machine 1, the sliding shaft 49 is slid so as to locate the position defining plate 48 in a removing position where the position defining plate 48 is pulled partially out of the copying machine 1. Under this condition, the depression lever 46 and the depression leaf spring 45 can be pivot freely without interference with the position defining plate 48.

The cleaning apparatus 23 may be mounted in such a manner that the engaging groove 40 of the supporting unit 39 is fitted from the fitting groove portion 41 of the supporting shaft 38, and then this engaging groove 40 is pushed to a preselected position. At this time, the supporting shaft 38 provided on the side of the copying machine 1 may guide the unsupported portion 39 to a predetermined position. At this time, since movement both the depression lever 46 and the depression leaf spring 45 are not restrained by the position defining plate 48, mounting of the cleaning apparatus 23 is easy. Thereafter, the sliding shaft 49 is moved a position within the copying machine 1 thus putting the position defining plate 48 into the defining position.

In the transfer apparatus 13, while the toner image is transferred from the photosensitive drum 6, the solenoid 52 is turned OFF, so that the plunger 51 is located at an extended position indicated by a dot and dash line shown in FIG. 4. As a result, both the depression lever 46 and the depression leaf spring 45 are moved to a disengagement position via position of the plunger 51, the solenoid lever 53, and the pivot shaft 47. At this time, the cleaning apparatus 23 is pivoted in the lower left direction of FIG. 2 due to gravity, so that both the main blade 36 and the lower blade 37 are not in contact with the transfer belt 21.

After the paper is transported between the secondary transfer roller 22 and the follower roller 16, and then the toner image on the transfer belt 21 is transferred, or at the same time while the toner image is being transferred, the signal is entered into the solenoid 52. As a result, the plunger 51 is located to a position indicated by a dotted line of FIG. 4, and at the same time, both the depression lever 46 and the depression spring 45 are brought to a position where the casing 34 of the cleaning apparatus 23 is depressed by these members 45 and 46.

At this time, tip portions of the main blade 36 and the lower blade 37 are depressed against the transfer belt 21. As a consequence, the toner remaining on the surface of the transfer belt 21 is stripped by the main blade 36 to be collected into the opening 35. The toner collected into the opening 35 is not leaked out due to the lower blade 37.

When the cleaning of the transfer belt 21 is not performed, since the opening 35 is pivoted about the supporting shaft 38, the opening 35 is rotated in such a manner that the opening 35 is directed to face upwardly. As a result, even in such a case that the toner adheres to the inside of the tip portion of the main blade 36, the toner may be collected into the casing 34 without being scattered outside the casing 34.

The present invention is not limited to the above-described embodiment, but may be modified.

For instance, (A) a fur brush may be used instead of the main blade 36 and the lower blade 37; (B) the cleaning apparatus may be applied to the normal copying machines with employment of the transfer belts, instead of the color copying machine; (C) the above-described cleaning apparatus may be employed as a cleaning apparatus of a photosensitive drum; and member (D) when the rotation direction of the transfer belt 21 is reversed with respect to the above-mentioned rotation direction, the main blade 36 may be mounted on the side edge located below the opening 35. In this case (D), the blade of the side edge located above the opening 35 may be omitted.

In the cleaning apparatus of the image forming apparatus according to the present invention, the cleaning member may be located to one position where this cleaning member is depressed against the surface of the object and the other position where this cleaning member is separated from this object surface by pivoting the casing around the fulcrum at a center, which is located below the opening of this casing. As a consequence, the cleaning apparatus can be made compact without deteriorating the cleaning function of the cleaning member. Furthermore, scattering of the toner stripped by the cleaning member can be avoided which is scattered outside the casing.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A cleaning apparatus for use in an image forming apparatus comprising:

a first shaft mounted in an image forming apparatus;

a casing mounted on said first shaft for pivotal movement about said first shaft, said casing having an opening formed therein configured to collect excess toner from a surface of an image retaining member in said image forming apparatus;

a cleaning member fixed to said casing adjacent to said opening, said cleaning member being configured to scrape excess toner from the surface of said image retaining member in response to said casing being pivoted to an engaged position with said image retaining member;

a second shaft mounted in said image forming apparatus;

an engagement mechanism mounted on said second shalt adjacent to said casing;

a drive means engaged with said engagement mechanism, said drive means configured to selectively pivot said engagement mechanism about said second shaft to a position whereby said casing is engaged by a portion of said engagement mechanism and moved into said engaged position in response to engagement with said portion of said engagement mechanism;

a third shaft mounted in said image forming apparatus; and a position defining mechanism mounted on said third shaft adjacent to said engagement mechanism, said position defining mechanism being slidable between a first position and a second position along an axial length of said third shaft, said position defining mechanism including a position defining member which is configured to limit pivotal movement of said portion of said engagement mechanism in response to said position defining mechanism being in said first position;

wherein with said position defining mechanism in said second position said portion of said engagement mechanism is spaced apart from said casing such that said casing is pivotable to a position whereby said casing is removable from said image forming apparatus with said opening of said casing being pointed in a generally upward direction.

2. The cleaning apparatus as set forth in claim 1, wherein:

said cleaning member is molted on said casing adjacent to an upper portion of said opening; and said cleaning apparatus further comprises an auxiliary cleaning member mounted on casing adjacent to a lower portion of said opening opposite said cleaning member with respect to said opening.

3. The cleaning apparatus as set forth in claim 2, wherein:

said cleaning member is a cleaning blade made of one of a synthetic resin and a metal.

4. The cleaning apparatus as set forth in claim 2, wherein:

said auxiliary cleaning member is a blade made of one of a synthetic resin and a metal.

5. The cleaning apparatus as set forth in claim 2, wherein:

a tip portion of said cleaning member located on said casing such that said casing being in said engaged position, said tip portion is depressed against said surface of said image retaining member.

6. The cleaning apparatus as set forth in claim 1, wherein:

said image retaining member is a photosensitive drum.

7. The cleaning apparatus as set forth in claim 1, wherein:

said image retaining member is an intermediate transfer belt onto which a toner image formed on the surface of the photosensitive drum is transferred, and which transfers said toner image onto transported paper.

8. The cleaning apparatus as set forth in claim 7 wherein:

said intermediate transfer belt is suspended between a drive roller and a follower roller.

9. The cleaning apparatus as set forth in claim 1, wherein:

said third shaft is generally parallel to said first shaft.

10. The cleaning apparatus as set forth in claim 1, wherein said first, second and third shafts are all generally parallel to one another.

11. The cleaning apparatus as set forth in claim 1, wherein said drive means comprises a solenoid.

12. The cleaning apparatus as set forth in claim 1, wherein said portion of said engagement mechanism comprises a leaf spring.

13. The cleaning apparatus as set forth in claim 1, wherein said first shaft if formed with at least fitting groove portion which allows for removal of said casing from said first shaft.

* * * * *